US007677070B2

(12) United States Patent
Kobayashi

(10) Patent No.: US 7,677,070 B2
(45) Date of Patent: Mar. 16, 2010

(54) SHOT-PEENING PROCESS

(75) Inventor: Yuji Kobayashi, Toyokawa (JP)

(73) Assignee: Sintokogio, Ltd., Aichi-Ken (JP)

( * ) Notice: Subject to any disclaimer, the term of this patent is extended or adjusted under 35 U.S.C. 154(b) by 132 days.

(21) Appl. No.: 11/921,928

(22) PCT Filed: Jun. 12, 2006

(86) PCT No.: PCT/JP2006/311763

§ 371 (c)(1),
(2), (4) Date: Dec. 13, 2007

(87) PCT Pub. No.: WO2006/134878

PCT Pub. Date: Dec. 21, 2006

(65) Prior Publication Data

US 2008/0202183 A1 Aug. 28, 2008

(30) Foreign Application Priority Data

Jun. 13, 2005 (JP) ..... 2005-172508

(51) Int. Cl.
*B24C 1/10* (2006.01)
*C21D 7/06* (2006.01)

(52) U.S. Cl. ..... 72/53; 29/90.7; 451/38; 148/525

(58) Field of Classification Search ..... 72/53; 29/90.7; 451/39, 40; 148/525
See application file for complete search history.

(56) References Cited

U.S. PATENT DOCUMENTS

| | | | | |
|---|---|---|---|---|
| 3,844,846 | A * | 10/1974 | Friske et al. | 72/53 |
| 4,086,104 | A * | 4/1978 | Kinoshita et al. | 29/90.7 |
| 4,424,083 | A * | 1/1984 | Polizzotti et al. | 148/286 |
| 6,610,154 | B2 * | 8/2003 | Limoges et al. | 148/525 |

FOREIGN PATENT DOCUMENTS

| | | | |
|---|---|---|---|
| JP | 1-103264 | A | 4/1989 |
| JP | 4-269166 | A | 9/1992 |
| JP | 6-145785 | A | 5/1994 |
| JP | 7-276235 | A | 10/1995 |
| JP | 9-176792 | | 7/1997 |

OTHER PUBLICATIONS

International Search Report dated Sep. 13, 2006.

* cited by examiner

*Primary Examiner*—David B Jones
(74) *Attorney, Agent, or Firm*—Finnegan, Henderson, Farabow, Garrett & Dunner, L.L.P.

(57) ABSTRACT

A method of shot peening in which with respect to a carburized and quenched metal part, only its surface abnormal layer detrimental to the fatigue strength thereof is scraped without scraping of the martensitic structure underlying the surface abnormal layer, namely, in which the fatigue strength can be rendered stable and enhanced without surface cracking. As bombardment shot, use is made of a shot with hardness higher than that (first hardness) of the surface abnormal layer occurring at a surface layer portion of metal part prior to shot peening but lower than that (second hardness) of the martensitic structure.

1 Claim, 3 Drawing Sheets

[Fig.1]
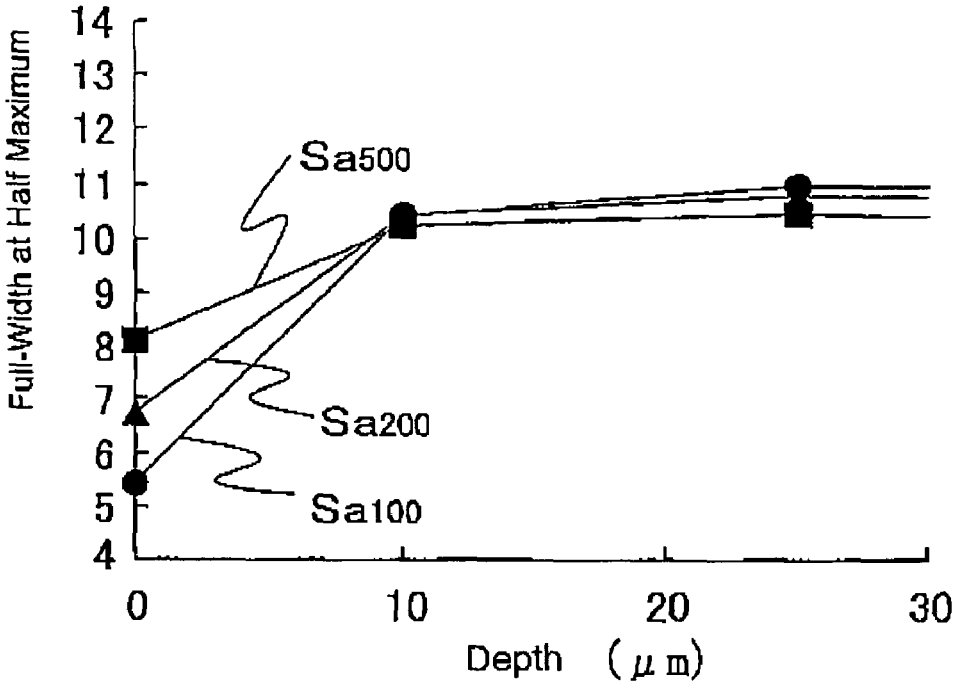
[Fig.2]
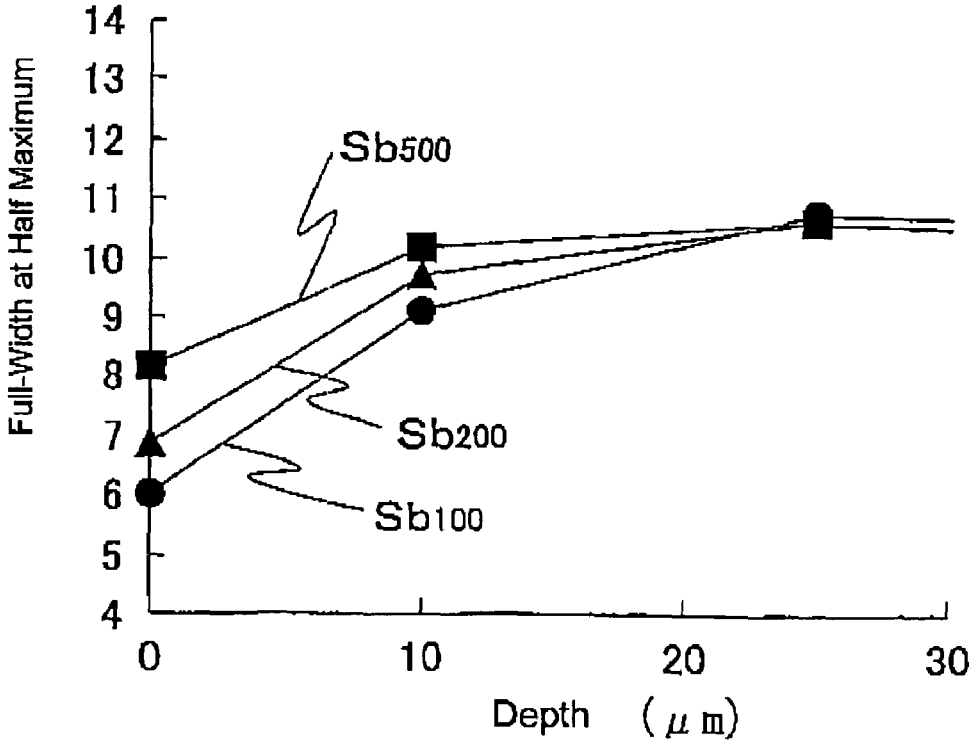

[Fig.3]
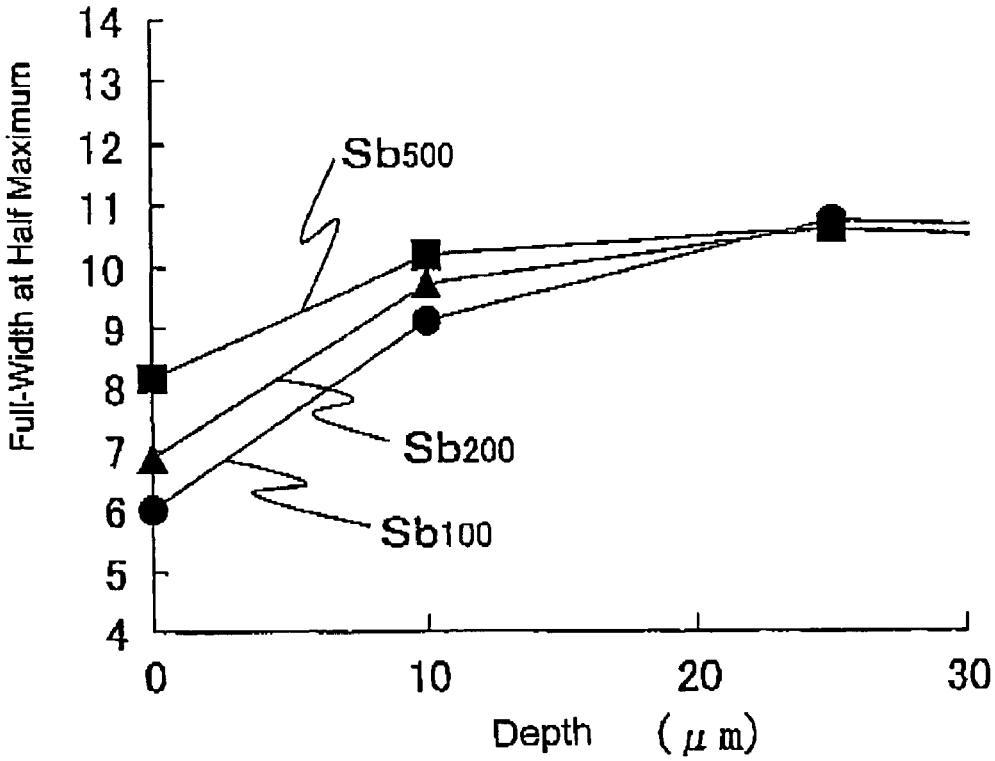
[Fig.4]
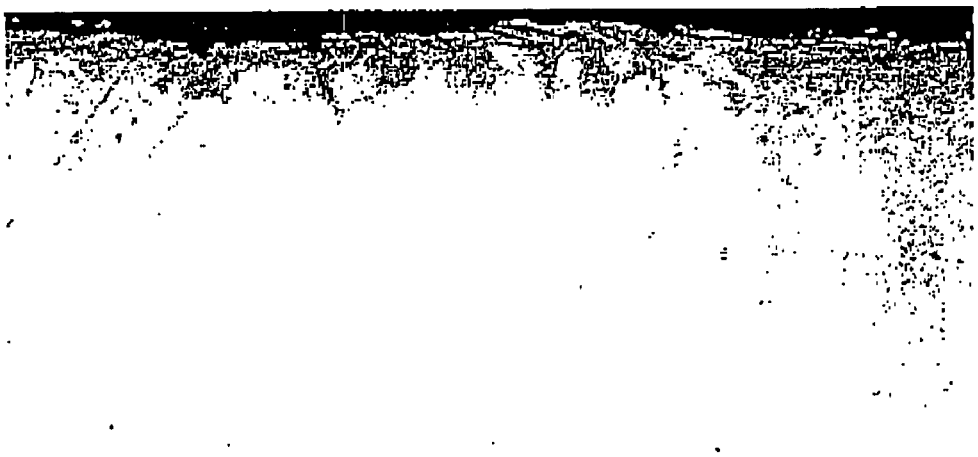

[Fig.5]
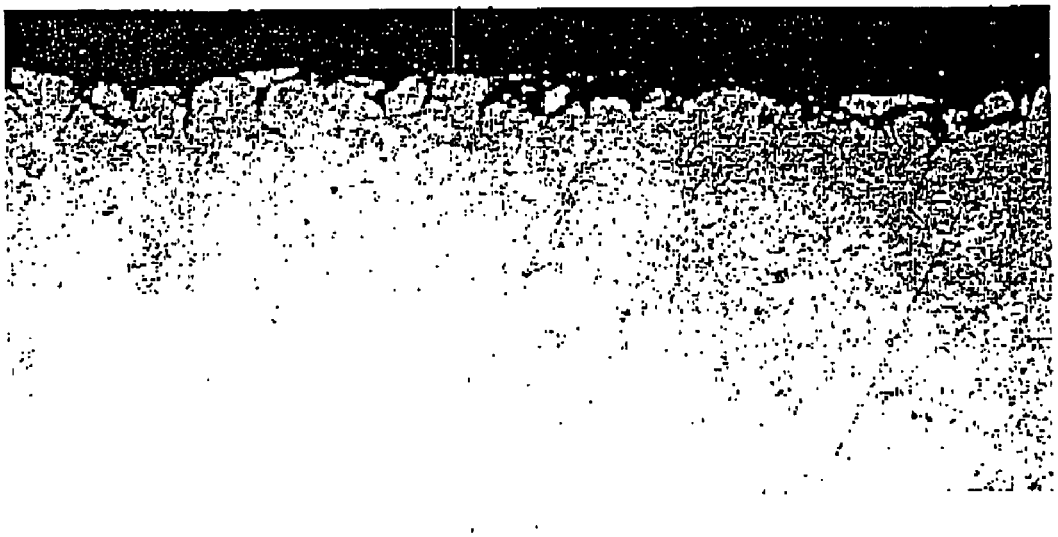
[Fig.6]
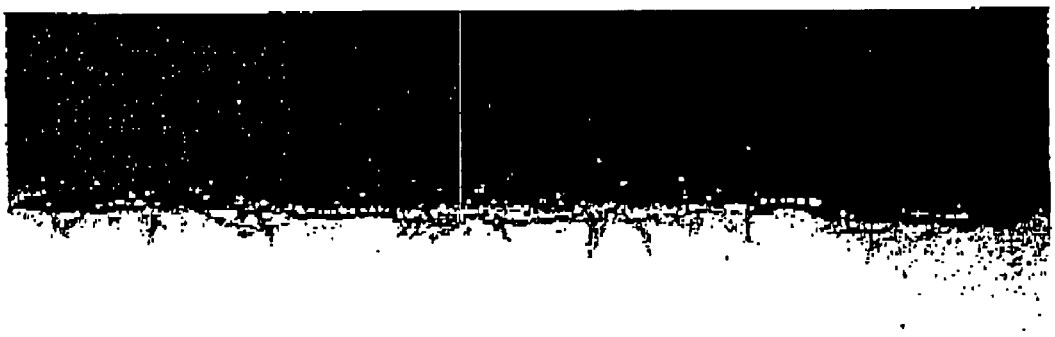

SHOT-PEENING PROCESS

FIELD OF THE INVENTION

This invention relates to a shot-peening process, in particular to such a process to be applied on a grain boundary oxidation layer formed on a metal surface that has been treated by a carburization and quenching process, or a carbonitriding and quenching process.

BACKGROUND OF THE INVENTION

To improve the fatigue strength of parts, such as automotive transmission gears, that require high fatigue strength, a shot-peening process is applied on a grain boundary oxidation layer formed on a metal surface of the part that has been treated by a gas carburization and quenching process. In the shot-peening process, as disclosed in Japanese Patent Early-Publication No. 9 [1997]-176792, the projected material (also called "shot"), whose particle size is 0.2 mm or less, is used to make the compressive residual stress as close to the surface as possible, and to reduce the surface roughness. It is intended to improve the contact pressure fatigue strength that is especially required for gearwheels.

With such a small size, the time needed to reach a predetermined coverage can be shortened, since there are many grams per unit weight. However, a certain time for treatment is needed, because of the problem of the stability of the projection device. For example, it is difficult to control the quantity of projected shot with a small particle size. As a result, the coverage of the shot-peening process on a metal surface that has been treated by a gas carburization and quenching process often becomes 500 to 1,000%, which is significantly larger than that of a usual shot-peening process.

Further, because the maximum shear stress expressed by Hertz' stress theory for shot with a small particle size is found at a shallow position, it is likely also found at any shallower position. Especially, a slack-quenching layer having tens of μm in thickness is formed on the surface of a carburizing article that uses RX gas, because of an oxidized grain boundary. (A, used herein, the slack-quenching layer, caused by the oxidized grain boundary, is often referred to as an "abnormal surface layer.") Further, any added elements, e.g., Mn and Cr, which have been originally added to improve a quenching and hardening process, have a chemical attraction to oxygen. Thus they become an oxide in a crystal grain boundary area during the carburization and diffusion processes. As a result, because the hardness of an area where the densities of these elements are reduced is also reduced, the area can be readily ablated.

In these contexts, the above publication, No. 9-176792, explains the following.

The required surface roughness after the shot peening process is about 1 μm or less in respect of the surface roughness and abrasion resistance, to avoid a cracking because of fatigue due to the notch effect. Accordingly, to have a surface roughness be about 1 μm or less, the depth of an abnormal surface layer before the shot-peening process should be about 15 μm or less.

The depth of an abnormal surface layer of a steel part should be about 15 μm or less by a carburization and quenching process or a nitrocarburizing and quenching process, to improve the compressive residual stress after the shot-peening process. The steel parts are then treated by the shot-peening process, in which the shot diameter is 0.1 to 1.0 mm, and the speed of the projected shot particles is 60 to 120 m/s.

Namely, these explanations mean that the conventional shot-peening process aggressively ablates an abnormal surface layer.

By a microscopic observation of the state where similar metals come in contact with each other and slide against each other, it is seen that such a state is that of solid lubrication, where solids directly contact each other, even if lubricating oil exists. Typically, if similar metals are in the solid lubrication state, the adhesion force is increased, and thus the coefficient of friction is increased. As a result, the depth of wear can be increased. Therefore, it is preferable that any thin film lie in the contact interface of the solids, to decrease the adhesion force.

SUMMARY OF THE INVENTION

Accordingly, one object of the present invention is to provide a shot-peening process to apply on a grain boundary oxidation layer that is formed on a metal surface that has been treated by a carburization and quenching process, or a carbonitriding and quenching process. To address the problem wherein a surface contact state has a high adhesion force, the shot-peening process enables a part of an abnormal surface layer to be maintained, rather than completely ablating it, to still exhibit an effect of the peening.

The shot-peening process comprises the steps of using shot particles and a projection device for projecting the shot particles, wherein the size of the shot particles is greater than 0.2 mm but not more than 1.0 mm, and wherein the hardness of the shot particles is greater than or equal to that of the processed article; and projecting the shot particles against the processed article to reach 100 to 500% in coverage by adjusting the shot projection speed under the shot-peening conditions for projecting the shot particles by the projecting device to be from 30 to 100 m/s, or by adjusting the pressure under the shot-peening conditions for projecting the shot particles by the projecting device to be from 0.1 to 0.5 MPa. Thereby the grain boundary oxidation layer is ablated, with a part of it still remaining.

In the process of the present invention, the size of the shot particles is greater than 0.2 mm, but 1.0 mm or less, as discussed above, for the following reasons. If the size of the shot particles is 0.2 mm or less, the number of balls per unit weight is increased. This makes it impossible to distinguish the coverages. In this case, the control of the shot-peening process is also impossible, since the ablation force becomes excessive. If the size of the shot particles is greater than 1.0 mm, the ablation force becomes lower, and this results in an insufficient process.

The projection device may be one that accelerates and projects the shot particles with an impeller or one that projects the shot particles by means of an air injection. If the projection device is one that projects the shot particles by means of the air injection, the speed of the projected shot may be adjusted to be from 30 to 100 m/s, to achieve a coverage of 100 to 500%. Or, the air pressure may be adjusted to be from 0.1 to 0.5 MPa.

In one embodiment of the present invention, the depth of the remaining grain boundary oxidation layer that remains after the ablation is at least 5 μm.

To determine the existence or non-existence of the remaining grain boundary oxidation layer that may remain after the ablation, a full-width at half maximum on the shot-peened surface is preferably measured. The full-width at half maximum is a numerical value that is an expression of the extent of a diffracted wave from an X-ray that is found in measuring a residual stress with an X-ray residual stress measurement device. Detecting the full-width at half maximum can non-destructively detect the existence or non-existence of any remaining grain boundary oxidation layer.

The coverage can be measured from the ratio of the total area of shot impact dents to the area of the shot-peened surface. Assuming the coverage of the shot-peening for one time is C1, the coverage Cn (%/100) of the shot-peening times the integer n is expressed by:

$$Cn=1-(1-C1)n.$$

Although the calculated value is about 98%, this may be considered as full coverage, and thus it is assumed to be 100% in actual coverage. 200% in coverage refers to the state to double the time that the coverage reaches 100%.

BRIEF DESCRIPTION OF THE DRAWINGS

FIG. 1 shows distributions of a full-width at half maximum in the direction of the depth when shot particles whose hardness is Hv800 and particle size is 0.6 mm are projected at a coverage of 100%, 200%, and 500%, of the shot-peening process of the present invention.

FIG. 2 is a graph similar to FIG. 1, but where the size of the shot particles is 0.8 mm.

FIG. 3 is a graph similar to FIG. 1, but where the size of the shot particles is 1.0 mm.

FIG. 4 is a sectional view of the shot-peened surface that has been treated by the shot-peening process of the present invention, where the size of the shot particles is 0.8 mm and the coverage is 100%.

FIG. 5 is a view similar to that of FIG. 4, but where the coverage is 200%.

FIG. 6 is a view similar to that of FIG. 4, but where the coverage is 500%.

PREFERRED EMBODIMENTS OF THE INVENTION

Illustrative embodiments of the shot-peening process of the present invention will now be explained. In these embodiments, a processed article is, as an example, a steel material (mark on the material: SCr420H) having a diameter of 8 mm, has been treated by a gas carburization and quenching process, and has a hardness of Hv800. The shot-peening process of the present invention is applied on the processed article under the conditions of Table 1. Table 1 also shows the coverages in the embodiments.

TABLE 1

| Particle | Shot size (mm) | Hardness (Hv) | Speed of Projection (m/s) | Coverage (%) |
|---|---|---|---|---|
| The first | 0.6 | 800 | 80 | 100 |
| Embodiment | 0.6 | 800 | 80 | 200 |
| | 0.6 | 800 | 80 | 500 |
| The second | 0.8 | 800 | 80 | 100 |
| Embodiment | 0.8 | 800 | 80 | 200 |
| | 0.8 | 800 | 80 | 500 |
| The third | 1.0 | 800 | 80 | 100 |
| Embodiment | 1.0 | 800 | 80 | 200 |
| | 1.0 | 800 | 80 | 500 |

FIGS. 1, 2, and 3 show distributions of full-width at half maximum in the direction of the depth when materials are projected. The particle sizes are 0.6 mm in the first embodiment, 0.8 mm in the second embodiment, and 1.0 mm in the third embodiment, as shown in Table 1. The full-width at half maximum was measured by a conventional X-ray stress-measuring device.

In FIGS. 1, 2, and 3, Sa, Sb, and Sc show that the particle size is 0.6 mm, 0.8 mm, and 1.0 mm, respectively, and the numbers 100, 200, and 500 show that coverage is 100%, 200%, and 500%, respectively. As shown in FIGS. 1, 2, and 3, the full-width at half maximum differs according to the particle sizes or the coverages at the distance 0 mm from the surface, i.e., the highest surface. The full-width at half maximum is from 10 to 11 in the inside, but is about 4 to 8 in the vicinity of the surface, in either condition of the shot-peening process.

FIGS. 4, 5, and 6 show enlarged sectional structures at a magnification of 400 of the processed article whose particle size is 0.8 mm and that has been treated by the shot-peening process of the present invention. The coverage is 100% (Sb100), 200% (Sb200), and 500% (Sb500), respectively. As seen from FIGS. 4, 5, and 6, the variations of the full-width at half maximum is due to an abnormal surface layer. If the abnormal surface layer is completely ablated, the full-width at half maximum is identical with those further inside. The respective depths of the abnormal surface layers of the enlarged sectional structures are about 20 μm in FIG. 4, about 10 μm in FIG. 5, and about 5 μm or more in FIG. 6.

With the shot-peening process of the present invention, on the surface of the processed article, e.g., an article that has been treated by a RX gas carburization and quenching process, an abnormal surface layer having the depth of at least 5 μm can still remain, and thus the adhesion force can be decreased, while a high fatigue strength under a surface contact pressure can be obtained.

Therefore, applying the shot-peening process of the present invention is not effective when an abnormal surface layer should be left so as to achieve an effect of solid lubrication of a product that should be treated by the shot-peening process.

Referring again to FIGS. 1 and 2, it is significant to note that the full-width at half maximum forms a rank order by coverage when the shot whose particle sizes are 0.6 mm (FIG. 1) and 0.8 mm (FIG. 2) are used. When the particle size is 1.0 mm (FIG. 3), although the full-width at half maximum corresponding to 100% in coverage is substantially the same as that corresponding to 200% in coverage, it varies at 500% in coverage. Therefore, by measuring the full-width at half maximum, whether the abnormal surface layer still remains can be determined. Thus the existence or non-existence of the abnormal surface layer can be freely adjusted by the particle size or the coverage. As seen from FIGS. 4, 5, and 6, the depths of the abnormal surface layers are controlled by the coverage.

In the prior art, determining the existence or non-existence of an abnormal surface layer typically lies on a microscopic direct observation of the cross section. However, such a microscopic observation requires that the product be broken and polished. Thus the problem arises in that the observation requires time. In contrast, on a surface that has been treated by the shot-peening process of the present invention, a remaining grain boundary oxidized layer or an abnormal surface layer can be nondestructively detected by measuring the full-width at half maximum on a metal surface.

The exemplification above shows a mere illustration, and is not intended to limit this invention, though it explains the method of processing by the shot-peening of this invention by the embodiments, which list a specific material and specific numerical value.

Although the embodiments of the shot-peening process of the present invention are explained with the specified material and the specified values, these are just for illustrative purposes, and do not limit the present invention.

As explained in the summary of the invention, the shot to be used in the process of the present invention has a particle size that is greater than 0.2 mm but no more than 1.0 mm, and has a hardness that is greater or equal to that of a processed article.

Although the forgoing embodiments use shot that has a hardness of Hv800, a steel ball that has a hardness of more than Hv700 may be used, depending on the article to be processed.

The shot-peening process of the present invention can be applied to products (for example, that may include, but are not limited to, automotive transmission gears) that are made of a steel alloy for mechanical structural use, such as SCr and SCM, etc., or products that have been treated by a gas carburization and quenching process using, e.g., the RX gas, or a carbonitriding and quenching process.

A peening device (a projection device) that projects the shot in the shot-peening process of the present invention may be one that accelerates and projects the shot with an impeller (a wheel), or one that can project the shot by means of air injection, but the device is not limited to these specified ones.

With the peening device of the air-injection type, as substitutes for adjusting the projection speed to be 30 to 100 m/s, an air pressure of 0.1 to 0.5 Mpa can be employed. Or, the speed of the projection may be 30 to 100 m/s, and the air pressure may be 0.1 to 0.5 Mpa.

The invention claimed is:

1. A shot-peening process to be applied on a grain boundary oxidation layer that is formed on a metal surface that has been treated by a carburization and quenching process, or a carbonitriding and quenching process, said shot-peening process comprising the steps of:

providing shot particles and a projection device for projecting the shot particles, wherein a size of the shot particles is greater than 0.2 mm but 1.0 mm or less, and wherein a hardness of the shot particles is greater than or equal to that of the metal surface;

projecting the shot particles against the metal surface to reach 100% to 500% in coverage by adjusting a speed of the projected shot, under shot-peening conditions for projecting the shot particles by said projecting device, to be from 30 to 100 m/s, or by adjusting a pressure, under shot-peening conditions for projecting the shot particles by said projecting device, to be from 0.1 to 0.5 MPa, whereby at least a part of the grain boundary oxidation layer is ablated; and determining the existence or non-existence of any remaining grain boundary oxidation layer that may remain after the ablation by measuring the full-width at half maximum on the surface that has been peened by the shot.

* * * * *